US009620849B2

(12) United States Patent
Azad et al.

(10) Patent No.: US 9,620,849 B2
(45) Date of Patent: Apr. 11, 2017

(54) COUPLED-FEED WIDEBAND ANTENNA

(71) Applicant: BlackBerry Limited, Waterloo (CA)

(72) Inventors: Mohammed Ziaul Azad, Irving, TX (US); Steven Eugene Downs, Irving, TX (US); Zhong Ji, Coppell, TX (US); David Fisk, Bedford, TX (US); Seong Heon Jeong, Irving, TX (US)

(73) Assignee: BlackBerry Limited, Waterloo, Ontario (CA)

( * ) Notice: Subject to any disclaimer, the term of this patent is extended or adjusted under 35 U.S.C. 154(b) by 264 days.

(21) Appl. No.: 13/908,823

(22) Filed: Jun. 3, 2013

(65) Prior Publication Data

US 2014/0354483 A1 Dec. 4, 2014

(51) Int. Cl.

| | |
|---|---|
| ***H01Q 1/24*** | (2006.01) |
| ***H01Q 9/30*** | (2006.01) |
| ***H01Q 5/385*** | (2015.01) |

(52) U.S. Cl.

CPC ..... *H01Q 1/243* (2013.01); *H01Q 5/385* (2015.01); *H01Q 9/30* (2013.01)

(58) Field of Classification Search

CPC ..... H01Q 9/0407; H01Q 5/385; H01Q 1/243; H01Q 9/30

USPC ..... 343/702

See application file for complete search history.

(56) References Cited

U.S. PATENT DOCUMENTS 6,650,294 B2 * 11/2003 Ying ..... H01Q 1/243 343/700 MS
6,985,114 B2 * 1/2006 Egashira ..... 343/702
2004/0246188 A1 12/2004 Egashira
2006/0077104 A1 4/2006 Usui et al.
2012/0001818 A1 1/2012 Lee et al.
2012/0299779 A1 11/2012 Yen et al.

FOREIGN PATENT DOCUMENTS

DE 10346800 5/2005

OTHER PUBLICATIONS

European Patent Office, "Extended European Search Report," issued in connection with European Application No. 13170266.4, dated Nov. 13, 2013, 9 pages.

Mimaki et al, "An Inverted FL Antenna for Dual-Frequency Operation," IEEE Transactions on Antennas and Propagation, vol. 53, No. 8, XP11137399, Aug. 2005, 5 pages.

* cited by examiner

*Primary Examiner* — Graham Smith
*Assistant Examiner* — Noel Maldonado
(74) *Attorney, Agent, or Firm* — Fish & Richardson P.C.

(57) ABSTRACT

A device having a coupled-feed wideband antenna is provided. The device comprises: a chassis comprising as a ground plane; an antenna feed, a ground side of the antenna feed connected to the ground plane; and, an antenna comprising: a first radiating arm configured for generating a first resonance at a first frequency, the first radiating arm connected to the chassis and hence the ground plane; a second radiating arm configured for generating a second resonance at a second frequency higher than the first frequency, the second radiating arm connected to the ground plane; and a third radiating arm configured for generating a third resonance at a third frequency higher than the second frequency, the first radiating arm capacitively coupled to the third radiating arm, and the third radiating arm connected to a positive side of the antenna feed.

16 Claims, 11 Drawing Sheets

COUPLED-FEED WIDEBAND ANTENNA

FIELD

The specification relates generally to antennas, and specifically to a coupled-feed wideband antenna.

BACKGROUND

Current mobile electronic devices, such as smartphones, tablets and the like, generally have different antennas implemented to support different types of wireless protocols and/or to cover different frequency ranges. For example, LTE (Long Term Evolution) bands, GSM (Global System for Mobile Communications) bands, UMTS (Universal Mobile Telecommunications System) bands, and/or WLAN (wireless local area network) bands, cover frequency ranges from 700 to 960 MHz, 1710-2170 MHz, and 2500-2700 MHz and the specific channels within these bands can vary from region to region necessitating the use of different antennas for each region in similar models of devices. This can complicate both resourcing and managing the different antennas for devices in each region.

BRIEF DESCRIPTIONS OF THE DRAWINGS

For a better understanding of the various implementations described herein and to show more clearly how they may be carried into effect, reference will now be made, by way of example only, to the accompanying drawings in which.

Figure 11:
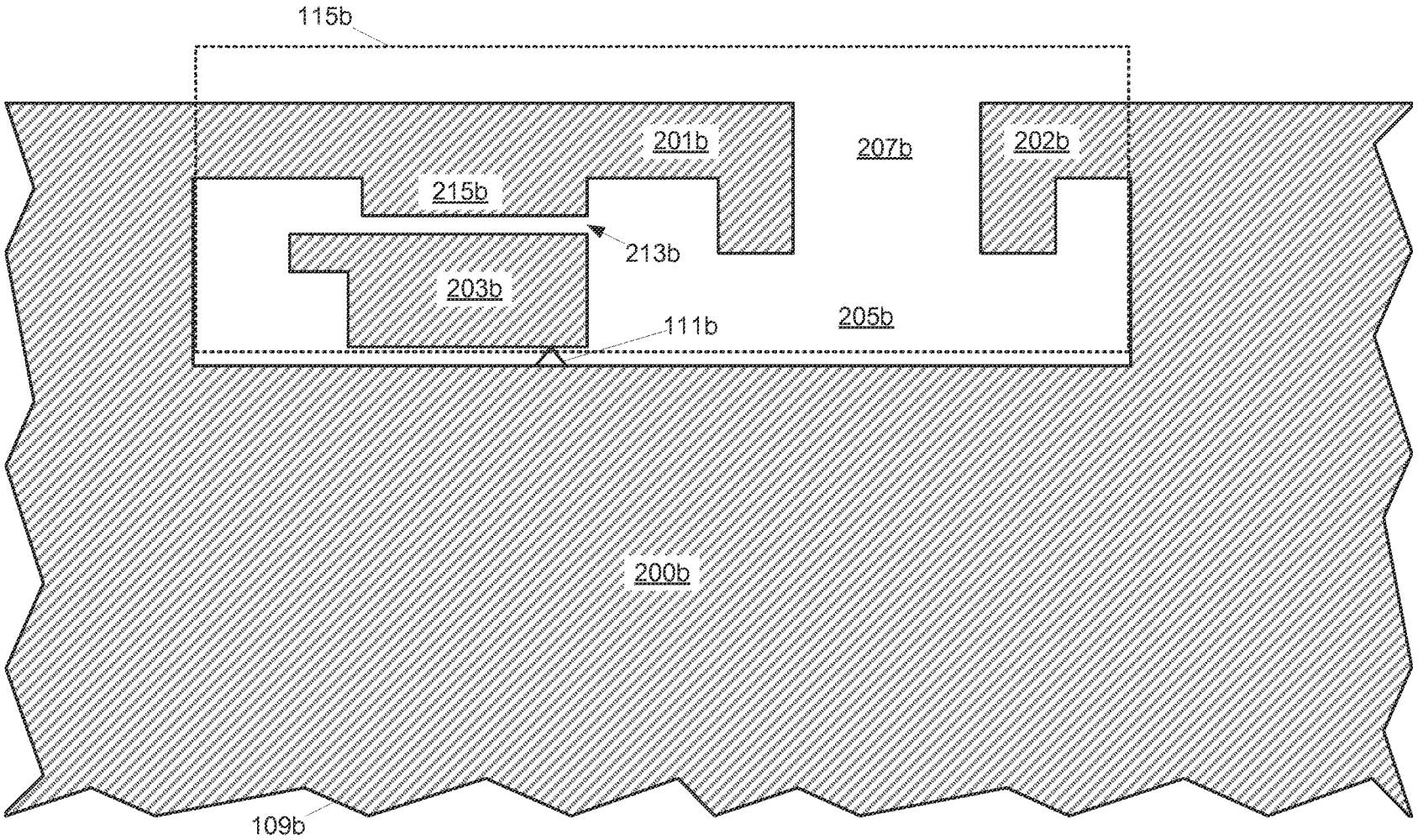

FIG. 11 an alternative coupled-feed wideband antenna, according to non-limiting implementations.

DETAILED DESCRIPTION

The present disclosure describes examples of a coupled-feed wideband antenna that can resonate at three frequency responses to cover bands that include channels for LTE bands, GSM bands, UMTS bands, and/or WLAN bands in a plurality of geographical regions.

In this specification, elements may be described as "configured to" perform one or more functions or "configured for" such functions. In general, an element that is configured to perform or configured for performing a function is enabled to perform the function, or is suitable for performing the function, or is adapted to perform the function, or is operable to perform the function, or is otherwise capable of performing the function.

Furthermore, as will become apparent, in this specification certain elements may be described as connected physically, electronically, or any combination thereof, according to context. In general, components that are electrically connected are configured to communicate (that is, they are capable of communicating) by way of electric signals. According to context, two components that are physically coupled and/or physically connected may behave as a single element. In some cases, physically connected elements may be integrally formed, e.g., part of a single-piece article that may share structures and materials. In other cases, physically connected elements may comprise discrete components that may be fastened together in any fashion. Physical connections may also include a combination of discrete components fastened together, and components fashioned as a single piece.

Furthermore, as will become apparent in this specification, certain antenna components may be described as being configured for generating a resonance at a given frequency and/or resonating at a given frequency and/or having a resonance at a given frequency. In general, an antenna component that is configured to resonate at a given frequency, and the like, can also be described as having a resonant length and/or a radiation length, an electrical length and the like corresponding to the given frequency. The electrical length can be similar to or different from a physical length of the antenna component. However, the electrical length of the antenna component can also be different from the physical length, for example by using electronic components to effectively lengthen the electrical length as compared to the physical length. However, the term electrical length is most often used with respect to simple monopole and/or dipole antennas. The resonant length can be similar to, or different from, the electrical length and the physical length of the antenna component. In general, the resonant length corresponds to an effective length of an antenna component used to generate a resonance at the given frequency; for example, for irregularly shaped and/or complex antenna components that resonate at a given frequency, the resonant length can be described as a length of a simple antenna component, including but not limited to a monopole antenna and a dipole antenna, that resonates at the same given frequency.

An aspect of the specification provides a device comprising: a chassis comprising a ground plane; an antenna feed, a ground side of the antenna feed connected to the ground plane; and, an antenna comprising: a first radiating arm configured for generating a first resonance at a first frequency, the first radiating arm connected to the ground plane; a second radiating arm configured for generating a second resonance at a second frequency higher than the first frequency, the second radiating arm connected to the ground plane; and a third radiating arm configured for generating a third resonance at a third frequency higher than the second frequency, the first radiating arm capacitively coupled to the third radiating arm, and the third radiating arm connected to a positive side of the antenna feed.

The first resonance can comprise a frequency range from about 700 MHz to about 960 MHz.

The second resonance can comprise a frequency range from about 1710 MHz to about 2170 MHz.

The third resonance can comprise a frequency range from about 2500 MHz to about 2700 MHz.

The third radiating arm can comprise a first rectangle and a second rectangle smaller than the first rectangle and forming an L-shape with the first rectangle.

The first radiating arm and the second radiating arm can be arranged along a line, and radiating ends of each of the first radiating arm and the second radiating arm can be separated by a gap for preventing capacitive coupling there between. The chassis can define an opening and the first radiating arm and the second radiating arm can extend along an outer edge of the opening. The third radiating arm can be located within the opening. The first radiating arm and the third radiating arm can be capacitively coupled across a gap. The gap can be less than about 1 mm wide. The first radiating arm can comprise a larger width than a remainder of the first radiating arm in a region that forms the gap with the third radiating arm. The region can be about 23.5 mm long.

The first radiating arm can be about 53 mm long.

The second radiating arm can be about 11 mm long.

The third radiating arm can comprise a first rectangle that can be about 6.5 mm by about 25 mm, and a second rectangle extending from a small edge of the first rectangle, and the second rectangle can be about 5 mm by about 3.3 mm.

One or more of the first radiating arm and the second radiating arm can be L-shaped.

The chassis can comprise one or more of a conducting material and a conducting metal.

The antenna can be at least partially integrated with the chassis.

The first radiating arm and the second radiating arm can be connected to the chassis using attachment portions.

Figure 1:
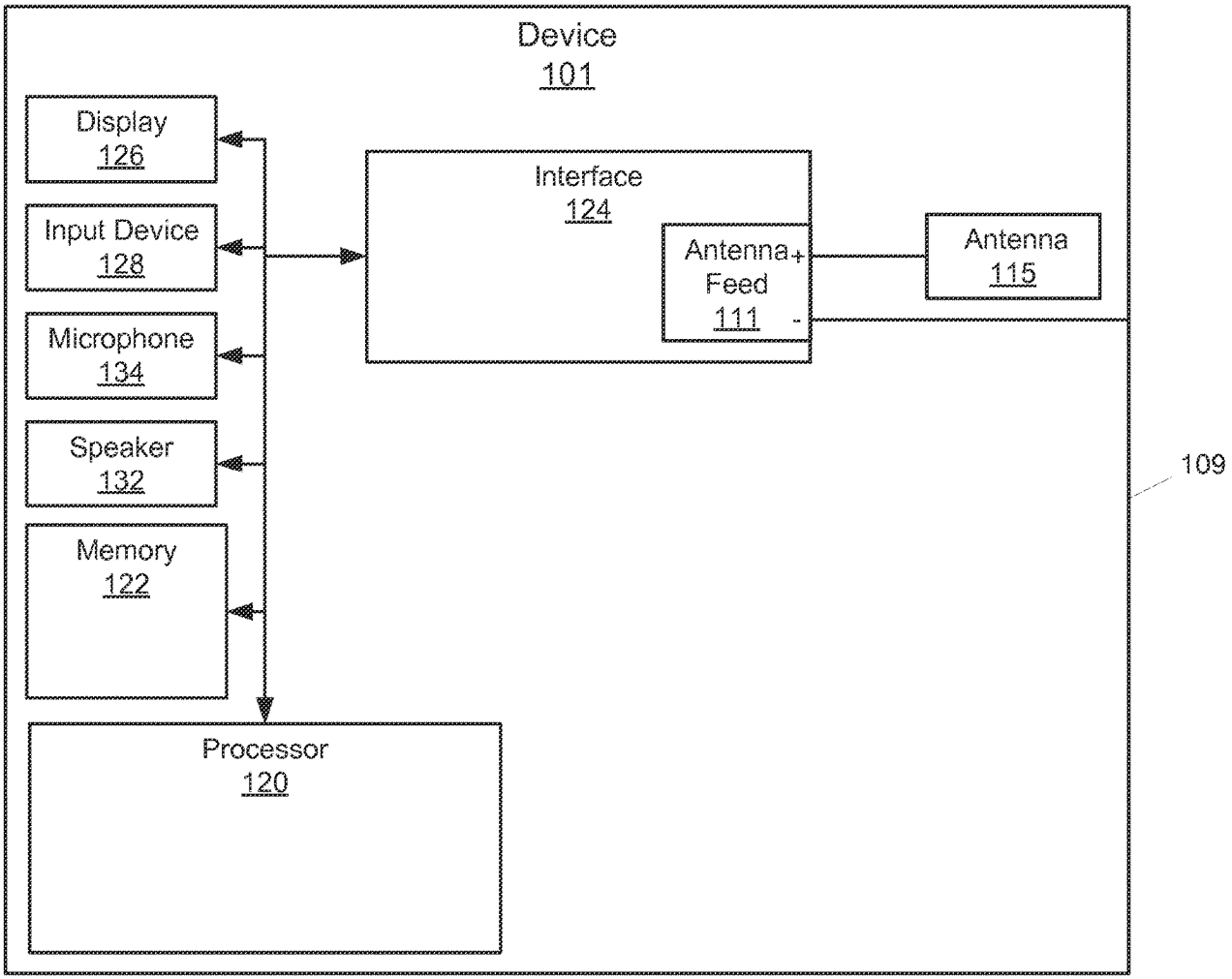
FIG. 1 depicts a schematic diagram of a device that includes a coupled-feed wideband antenna, according to non-limiting implementations.

FIG. 1 depicts a schematic diagram of a mobile electronic device 101, referred to interchangeably hereafter as device 101. Device 101 comprises: a chassis 109 comprising a ground plane; and antenna feed 111, a ground side (labelled "–" in FIG. 1) of antenna feed 111 connected to the ground plane, and a coupled-feed wideband antenna 115, described in further detail below. Coupled-feed wideband antenna 115 will be interchangeably referred to hereafter as antenna 115. Device 101 can be any type of electronic device that can be used in a self-contained manner to communicate with one or more communication networks using antenna 115. Device 101 includes, but is not limited to, any suitable combination of electronic devices, communications devices, computing devices, personal computers, laptop computers, portable electronic devices, mobile computing devices, portable computing devices, tablet computing devices, laptop computing devices, desktop phones, telephones, PDAs (personal digital assistants), cellphones, smartphones, e-readers, internet-enabled appliances and the like. Other suitable devices are within the scope of present implementations. Device hence further comprise a processor 120, a memory 122, a display 126, a communication interface 124 that can optionally comprise antenna feed 111, at least one input device 128, a speaker 132 and a microphone 134.

It should be emphasized that the structure of device 101 in FIG. 1 is purely an example, and contemplates a device that can be used for both wireless voice (e.g. telephony) and wireless data communications (e.g. email, web browsing, text, and the like). However, FIG. 1 contemplates a device that can be used for any suitable specialized functions, including, but not limited, to one or more of, telephony, computing, appliance, and/or entertainment related functions.

Device 101 comprises at least one input device 128 generally configured to receive input data, and can comprise any suitable combination of input devices, including but not limited to a keyboard, a keypad, a pointing device, a mouse, a track wheel, a trackball, a touchpad, a touch screen and the like. Other suitable input devices are within the scope of present implementations.

Input from input device 128 is received at processor 120 (which can be implemented as a plurality of processors, including but not limited to one or more central processors (CPUs)). Processor 120 is configured to communicate with a memory 122 comprising a non-volatile storage unit (e.g. Erasable Electronic Programmable Read Only Memory ("EEPROM"), Flash Memory) and a volatile storage unit (e.g. random access memory ("RAM")). Programming instructions that implement the functional teachings of device 101 as described herein are typically maintained, persistently, in memory 122 and used by processor 120 which makes appropriate utilization of volatile storage during the execution of such programming instructions. Those skilled in the art will now recognize that memory 122 is an example of computer readable media that can store programming instructions executable on processor 120. Furthermore, memory 122 is also an example of a memory unit and/or memory module.

Processor 120 can be further configured to communicate with display 126, and microphone 134 and speaker 132. Display 126 comprises any suitable one of, or combination of, CRT (cathode ray tube) and/or flat panel displays (e.g. LCD (liquid crystal display), plasma, OLED (organic light emitting diode), capacitive or resistive touchscreens, and the like). Microphone 134, comprises any suitable microphone for receiving sound and converting to audio data. Speaker 132 comprises any suitable speaker for converting audio data to sound to provide one or more of audible alerts, audible communications from remote communication devices, and the like. In some implementations, input device 128 and display 126 are external to device 101, with processor 120 in communication with each of input device 128 and display 126 via a suitable connection and/or link.

Processor 120 also connects to communication interface 124 (interchangeably referred to interchangeably as interface 124), which can be implemented as one or more radios and/or connectors and/or network adaptors, configured to wirelessly communicate with one or more communication networks (not depicted) via antenna 115. It will be appreciated that interface 124 is configured to correspond with network architecture that is used to implement one or more communication links to the one or more communication networks, including but not limited to any suitable combination of USB (universal serial bus) cables, serial cables, wireless links, cell-phone links, cellular network links (including but not limited to 2G, 2.5G, 3G, 4G+ such as UMTS (Universal Mobile Telecommunications System), GSM (Global System for Mobile Communications), CDMA (Code division multiple access), FDD (frequency division duplexing), LTE (Long Term Evolution), TDD (time division duplexing), TDD-LTE (TDD-Long Term Evolution), TD-SCDMA (Time Division Synchronous Code Division Multiple Access) and the like, wireless data, Bluetooth links, NFC (near field communication) links, WLAN (wireless local area network) links, WiFi links, WiMax links, packet based links, the Internet, analog networks, the PSTN (public switched telephone network), access points, and the like, and/or a combination.

Specifically, interface 124 comprises radio equipment (i.e. a radio transmitter and/or radio receiver) for receiving and transmitting signals using antenna 115. It is further appreciated that interface 124 can comprise antenna feed 111, which alternatively can be separate from interface 124.

It is yet further appreciated that device 101 comprises a power source, not depicted, for example a battery or the like. In some implementations the power source can comprise a connection to a mains power supply and a power adaptor (e.g. and AC-to-DC (alternating current to direct current) adaptor).

It is yet further appreciated that device 101 further comprises an outer housing which houses components of device 101, including chassis 109. Chassis 109 can be internal to the outer housing and be configured to provide structural integrity to device 101. Chassis 109 can be further configured to support components of device 101 attached thereto, for example, display 126. In specific implementations chassis 109 can comprise one or more of a conducting material and a conducting metal, such that chassis 109 forms the ground plane; in alternative implementations, at least a portion of chassis 109 can comprise one or more of a conductive covering and a conductive coating which forms the ground plane.

In any event, it should be understood that a wide variety of configurations for device 101 are contemplated.

Figure 2:
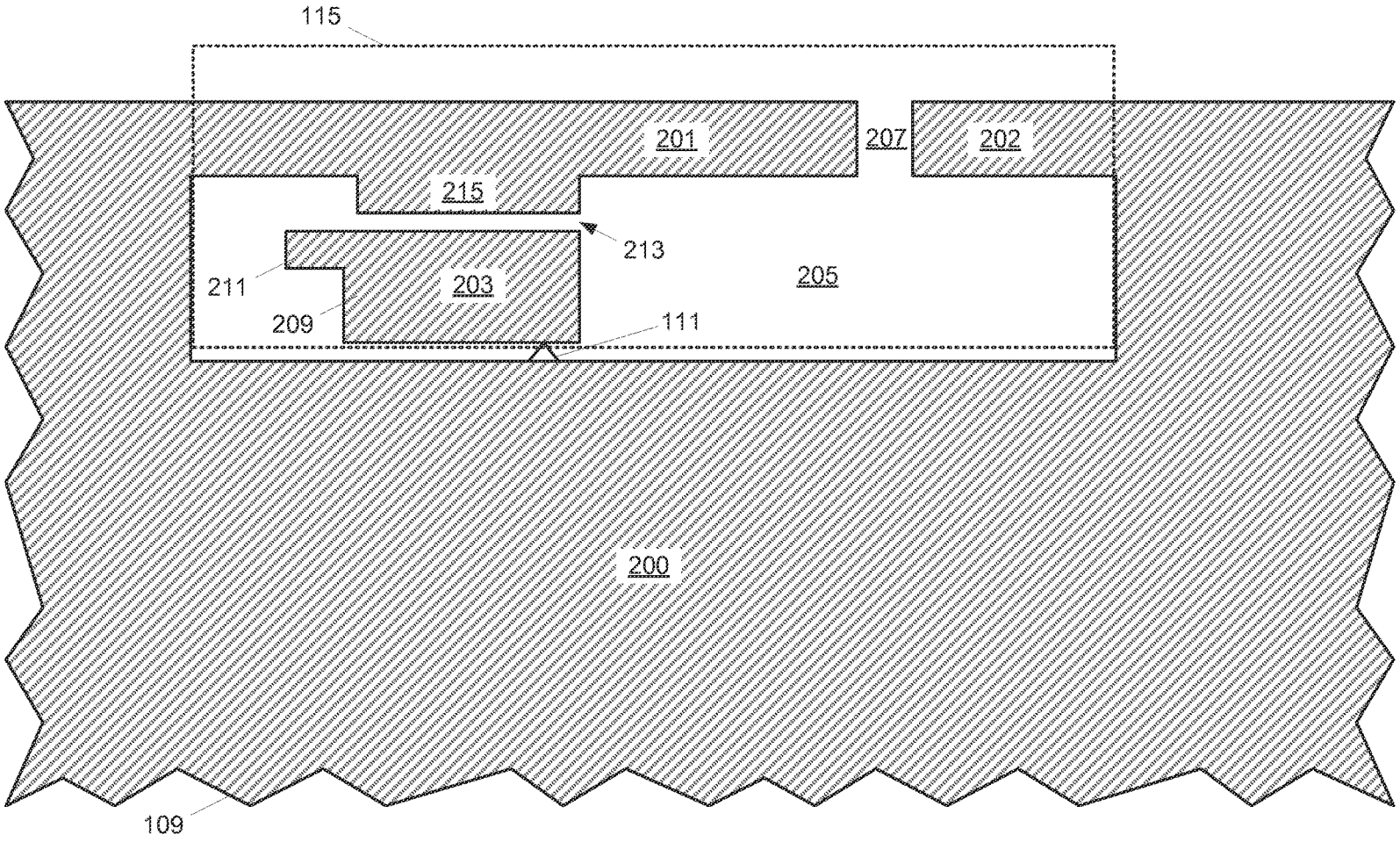
FIG. 2 depicts a schematic diagram of the coupled-feed wideband antenna of FIG. 1, according to non-limiting implementations.

Attention is next directed to FIG. 2, which depicts non-limiting implementations of antenna 115 at least partially integrated with chassis 109. Specifically, FIG. 2 depicts an internal portion of device 101 that includes chassis 109 comprising ground plane 200, connection portions of antenna feed 111, and antenna 115. It is appreciated that FIG. 2 does not depict all of chassis 109, but a portion that includes antenna 115.

In general, antenna 115 comprises: a first radiating arm 201 configured for generating a first resonance at a first frequency, first radiating arm 201 connected to ground plane 200 (i.e. as depicted, first radiating arm 201 is connected to chassis 109); a second radiating arm 202 configured for generating a second resonance at a second frequency higher than the first frequency, second radiating arm 202 connected to ground plane 200 (i.e. as depicted, second radiating arm 202 is connected to chassis 109); and a third radiating arm 203 configured for generating a third resonance at a third frequency higher than the second frequency, first radiating arm 201 capacitively coupled to third radiating arm 203, and third radiating arm 203 connected to a positive side of antenna feed 111 (i.e. a side opposite the ground side of antenna feed 111, and/or the side labelled "+" in FIG. 1).

In these implementations first radiating arm 201 and second radiating arm 202 are integrated with chassis 109 and hence ground plane 200; hence components of antenna 115 are indicated In FIG. 2 using stippled lines. Hence, each of first radiating arm 201 and second radiating arm 202 comprise monopole parasitic components in communication with antenna feed 111 using third radiating arm 203.

Furthermore, third radiating arm 203 comprises a monopole antenna located in an opening 205 formed by first radiating arm 201, second radiating arm 202 and chassis 109. Specifically, first radiating arm 201 and second radiating arm 202 are arranged along a line along an outer side of chassis 109, and radiating ends of each of first radiating arm 201 and second radiating arm 202 are separated by a gap 207 for preventing capacitive coupling there between. In other words, gap 207 is wide enough so that capacitive coupling does not occur between first radiating arm 201 and second radiating arm 202. Furthermore, in depicted implementations, as first radiating arm 201 and second radiating arm 202 are integrated with chassis 109, chassis 109 defining and/or forming opening 205, and first radiating arm 201 and second radiating arm 202 extend along an outer edge of opening 205. Further gap 207 extends from an outer edge of each of first radiating arm 201 and second radiating arm 202 into opening 205.

Third radiating arm is located within opening 205 but is not electrically connected to chassis 109 other than through antenna feed 111. In depicted implementations, third radiating arm 203 comprises a first rectangle 209 and a second rectangle 211 smaller than first rectangle 209 and forming an L-shape with first rectangle 209; further, as depicted first radiating arm 201 is capacitively coupled to third radiating arm 203 along a portion of first rectangle 209 but not second rectangle 211. However, in other implementations, first radiating arm 201 can be capacitively coupled to third radiating arm 203 along a portion of one or more of first rectangle 209 and second rectangle 211.

It is yet further appreciated that first radiating arm 201 and third radiating arm 203 are capacitively coupled across a gap 213 there between. In other words, gap 213 is small enough for capacitive coupling to occur between first radiating arm 201 and third radiating arm 203; this effects the resonance frequency of each and allows for greater versatility in designing antenna 115. Indeed, antenna feed 111 can hence feed first radiating arm 201 using both ground plane 200 and the capactive coupling with third radiating arm 203 across gap 213.

A width of gap 213 can be controlled by widening at least a portion of first radiating arm 201. For example, in depicted implementations, first radiating arm 201 comprises a larger width than a remainder of first radiating arm 201 in a region 215 that forms gap 213 with third radiating arm 203. Widening of first radiating arm 201 is described below with reference to FIG. 8.

It is further appreciated that antenna 115 is configured to generate resonances at three frequencies corresponding to each of first radiating arm 201, second radiating arm 202 and third radiating arm 203. In specific non-limiting implementations, antenna 115 can be configured to generate resonances in frequency bands corresponding to one or more of LTE frequency bands, GSM frequency bands, UMTS frequency bands and WLAN frequency bands.

Figure 3:
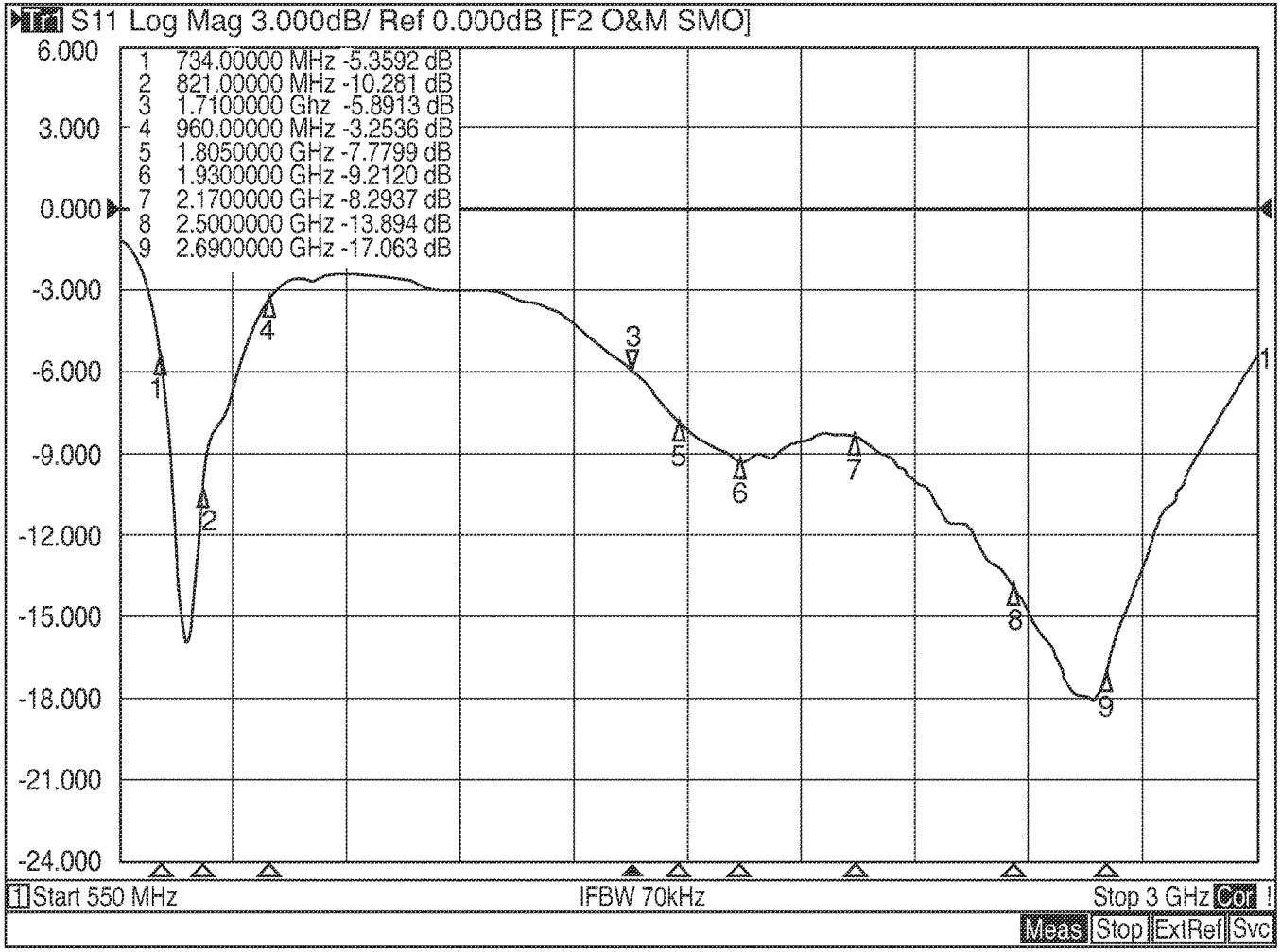
FIG. 3 depicts a return-loss curve of the coupled-feed wideband antenna of FIG. 1, according to non-limiting implementations.

For example, attention is directed to FIG. 3 which depicts a return-loss curve for specific non-limiting implementations of successful prototypes of antenna 115 between about 650 MHz and about 3000 MHz (or 3 GHz), with return-loss shown on the Y-axis and frequency shown on the x-axis.

In these implementations, first radiating arm 201 generates the first resonance at a first frequency, the first resonance comprising a frequency range of about 700 MHz to about 960 MHz (e.g. including point 1 at about 734 MHz, point 2 at about 821 MHz, and point 4 at about 960 MHz on the return-loss curve). In other words, from FIG. 3 it is apparent that the first frequency is about 800 MHz, and the first resonance has a bandwidth that includes frequencies in a frequency range of about 700 MHz to about 960 MHz.

However, by adjusting the dimensions of antenna 115, both the first frequency and the bandwidth of the first resonance can be tuned.

Further, second radiating arm 202 generates the second resonance, the second resonance comprising a frequency range of about 1710 MHz to about 2170 MHz (e.g. including point 3 at about 1710 MHz, point 5 at about 1805 MHz, point 6 at about 1930 MHz and point 7 at about 2170 MHz on the return-loss curve). In other words, from FIG. 3 it is apparent that the second frequency is about 1930 MHz, and the first resonance has a bandwidth that includes frequencies in a frequency range of about 1710 MHz to about 2170 MHz. However, by adjusting the dimensions of antenna 115, both the second frequency and the bandwidth of the second resonance can be tuned.

Further, third radiating arm 203 generates the third resonance, the third resonance comprising a frequency range of about 2500 MHz to about 2700 MHz (e.g. including point 8 at about 2500 MHz and point 9 at about 2690 MHz on the return-loss curve). In other words, from FIG. 3 it is apparent that the third frequency is about 2670 MHz, and the first resonance has a bandwidth that includes frequencies in a frequency range of about 2500 MHz to about 2700 MHz. However, by adjusting the dimensions of antenna 115, both the third frequency and the bandwidth of the third resonance can be tuned.

Furthermore, antenna 115 can achieve good efficiency over these frequency ranges. For example, attention is directed to FIG. 4 which depicts efficiency of specific non-limiting implementations the successful prototypes of antenna 115 over a similar frequency range as that depicted in FIG. 3, with efficiency shown on the y-axis and frequency shown on the x-axis. The poorest efficiency is about −4.5 dB, around 950 MHz, while the best efficiency is around −0.8 dB at around 2060 MHz, with a relatively flat efficiency from about 1710 MHz to about 2700 MHz.

Figure 4:
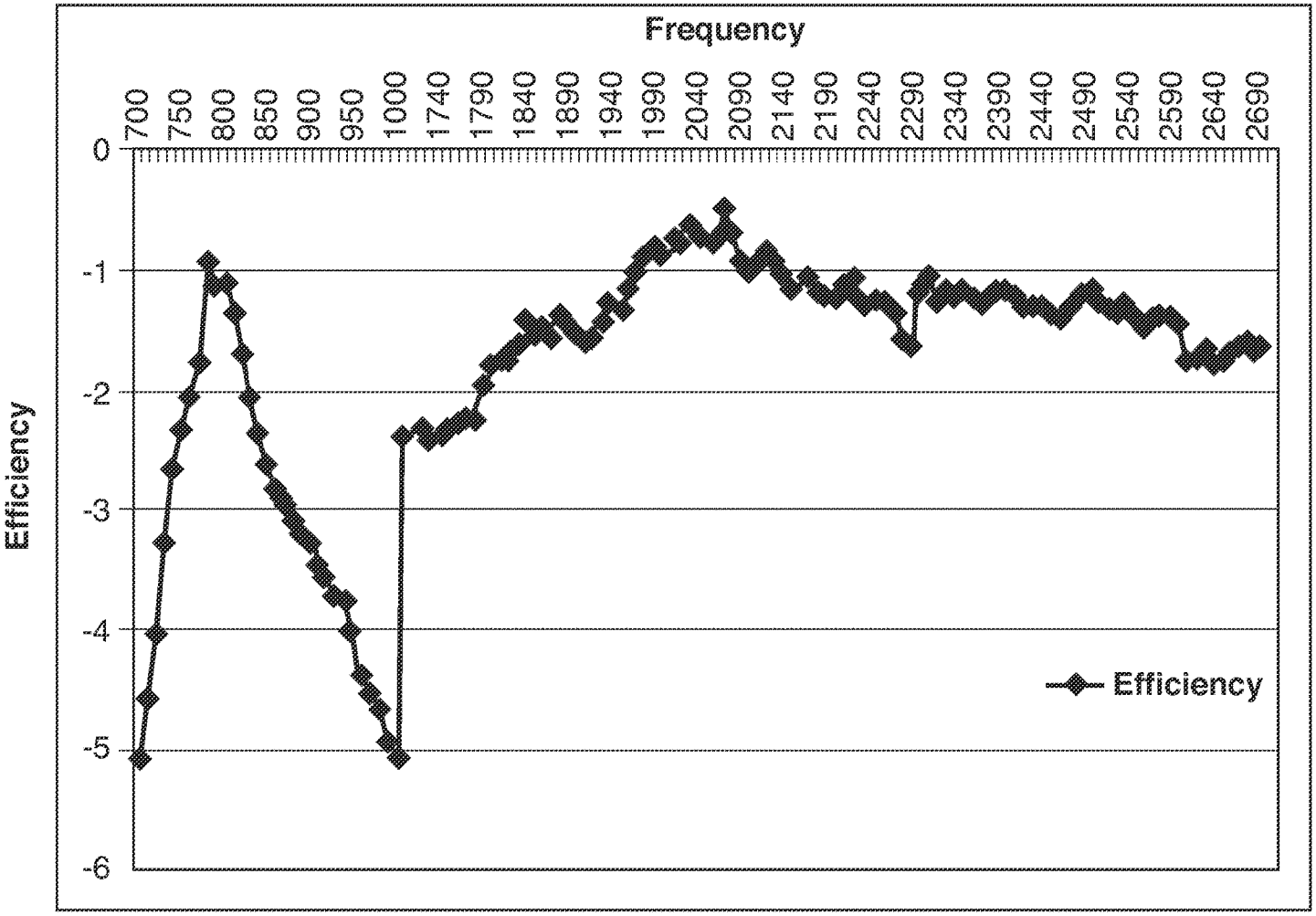
FIG. 4 depicts an efficiency curve of the coupled-feed wideband antenna of FIG. 1, according to non-limiting implementations.

Dimensions and/or shapes of antenna 115 and each of first radiating arm 201, second radiating arm 202 and third radiating arm 203 can be varied heuristically and/or experimentally to determine dimensions for achieving the return-loss curve of FIG. 3 and the efficiency of FIG. 4. For example, attention is directed to FIG. 5 which depicts a subset of the portion of chassis 109 depicted in FIG. 2, and first radiating arm 201, second radiating arm 202 and third radiating arm 203, as well as dimensions thereof used to achieve the return-loss curve of FIG. 3 and the efficiency of FIG. 4 in a successful prototype.

In these implementations, first radiating arm 201 is about 53 mm long, second radiating arm 202 is about 11 mm long, and third radiating arm 203 comprises first rectangle 209 that is about 6.5 mm by about 25 mm, and second rectangle 211 extending from a small edge of first rectangle 209, second rectangle 211 being about 5 mm by about 3.3 mm.

First radiating arm 201 is capacitively coupled to third radiating arm 203 across gap 213, gap 213 being less than about 1 mm. Furthermore, region 215 is about 23.5 mm long, slightly less than the length of about 25 mm of first rectangle 209.

Gap 207 between first radiating arm 201 and second radiating arm 202 is about 3 mm. Each of first radiating arm 201 and second radiating arm 202 is about 4.5 mm wide, and region 215 is about 2.5 mm wider than a remainder of first radiating arm 201.

Opening 205 is about 67 mm by about 10 mm, and furthermore, as depicted, a right edge of third radiating arm 203 is located about 29.5 mm from a right edge of opening 205. A left edge of first rectangle 209 of third radiating arm 203 is located about 12.5 mm from a left edge of opening 205. Further, a bottom edge of third radiating arm 203 is separated from chassis 109 by a gap of less than about 1 mm; in some implementations the gap between a bottom edge of third radiating arm 203 and chassis is about 0.7 mm. It is appreciated, however, that the terms "right", "left", and "bottom" are only meant to refer to FIG. 5 and is not meant to imply that the referred to edges are always located on the right or on the bottom; rather, components depicted in FIG. 5 can be rotated in any given direction.

Figure 5:
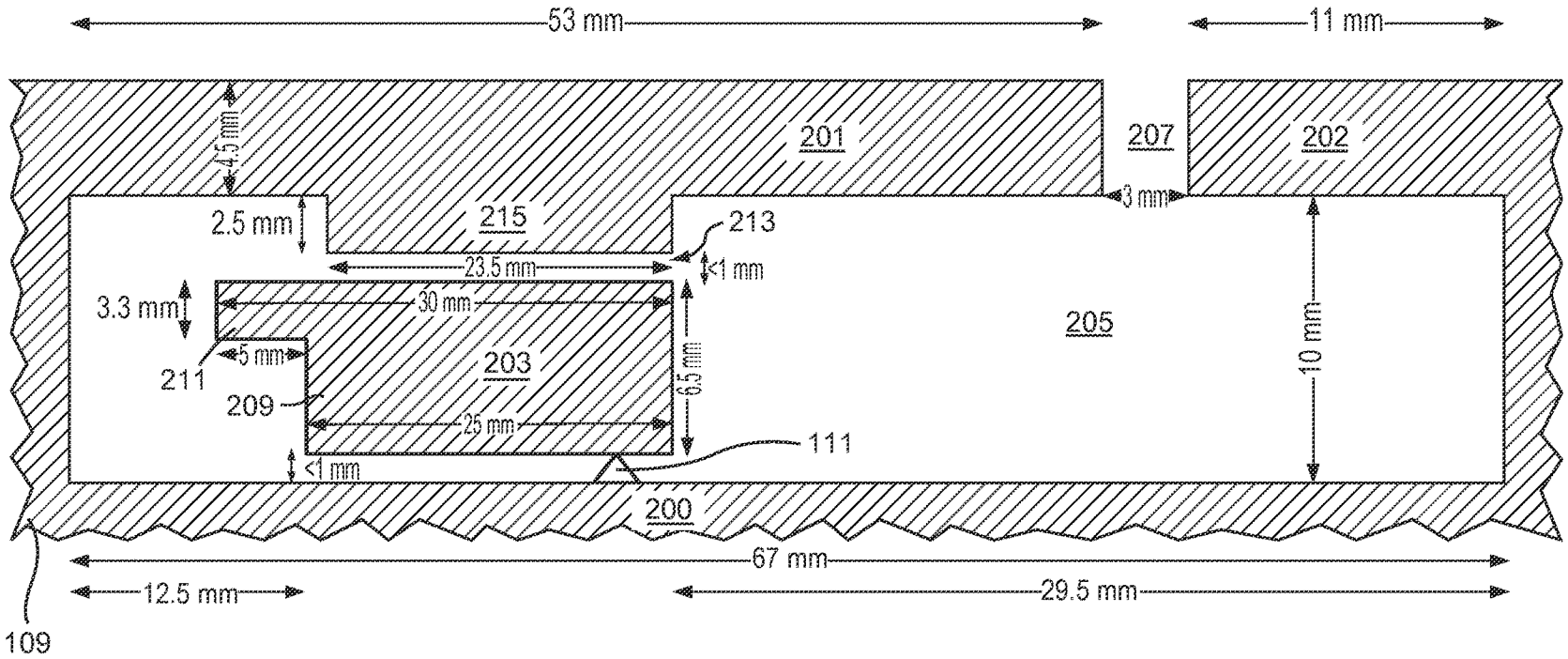
FIG. 5 depicts dimensions of the coupled-feed wideband antenna of FIG. 1 used to produce the return-loss curve of FIG. 3 and the efficiency curve of FIG. 4, according to non-limiting implementations.

However, while specific dimensions are depicted in FIG. 5, in other implementations, other dimensions and/or shapes of components of antenna 115 can be used to achieve resonances at different bandwidths.

It is further appreciated that, in present implementations, a chassis of a device can be adapted to form at least a portion of antenna 115. For example, attention is directed to FIG. 6, which depicts a same portion of chassis 109 of device 101 as in FIG. 2, prior to chassis 109 being adapted to form antenna 115. It is appreciated that chassis 109 forms opening 205 and chassis 109 further includes ground plane 200. Opening 205 can be a feature of chassis 109 provided specifically for an antenna structure, such as antenna 115. In any event, stippled vertical lines 601 correspond to edges of gap 207 and it is appreciated that the area of chassis 109 between lines 601 can be removed and/or machined away to form first radiating arm 201, second radiating arm 202 and gap 207.

Figure 6:
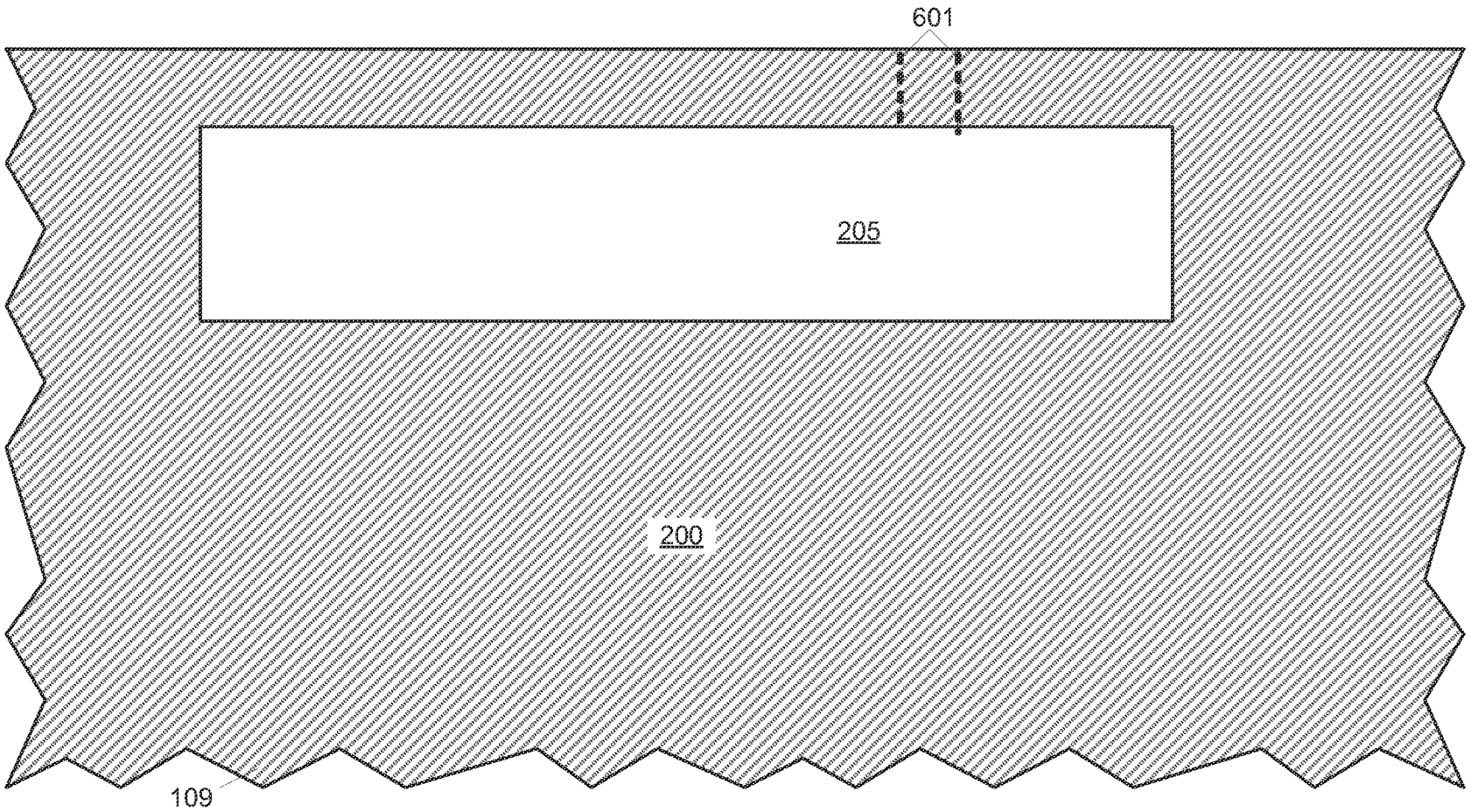
FIG. 6 depicts a portion of the chassis of the device of FIG. 1 prior to being adapted to include the coupled-feed wideband antenna, according to non-limiting implementations.
Figure 7:
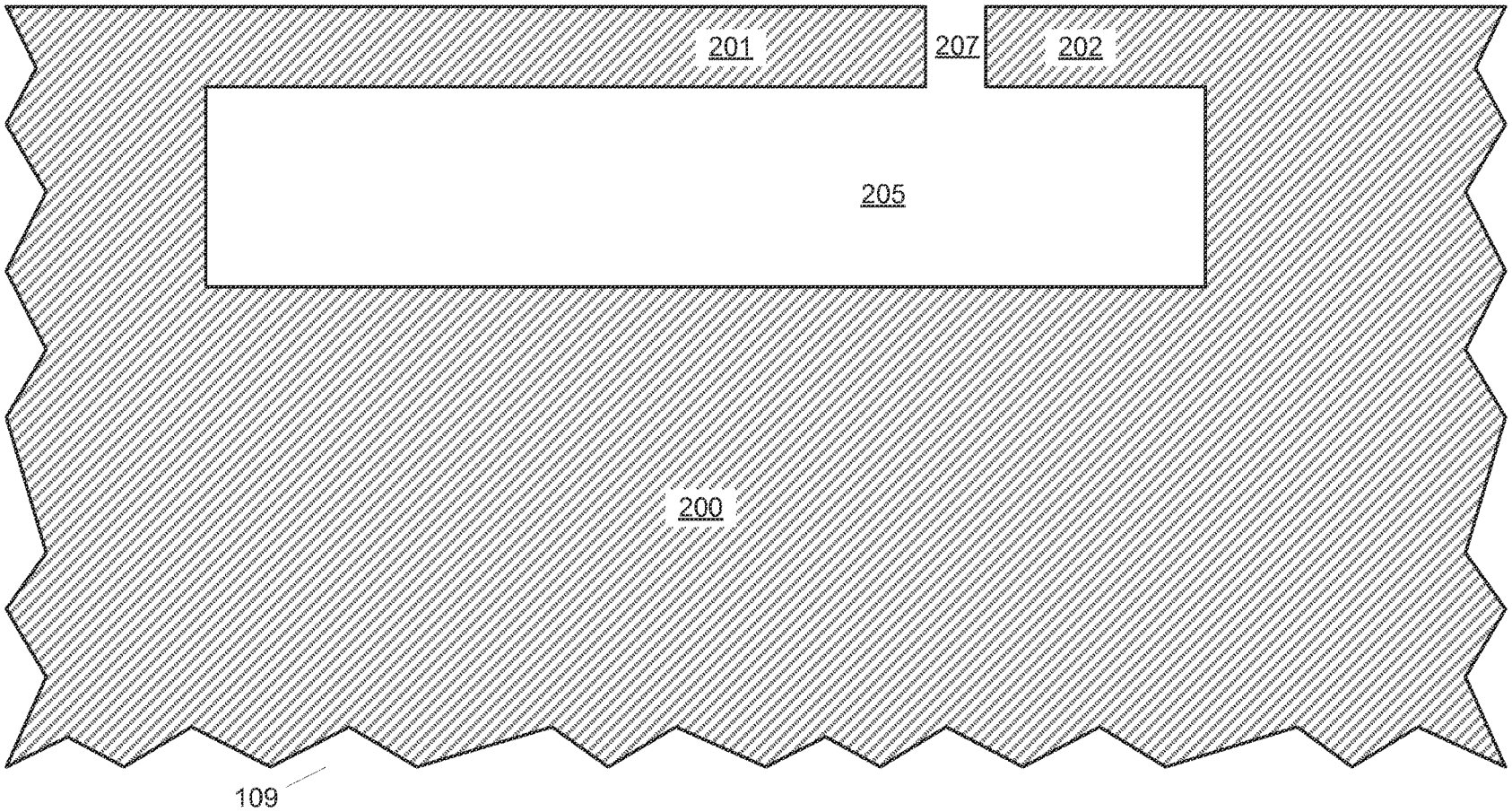
FIG. 7 depicts the portion of the chassis of FIG. 6 adapted to form a first radiating arm and a second radiating arm of the coupled-feed wideband antenna, according to non-limiting implementations.

Indeed, attention is next directed to FIG. 7 which is similar to FIG. 6, however material from the area of chassis 109 between lines 601 has been removed and/or machined away to form first radiating arm 201, second radiating arm 201, and gap 207.

In some implementations, a width of first radiating arm 201 can initially be about a width of region 215 and material can be removed, machined away and the like to narrow a width of first radiating arm 201 except in region 215. Indeed, the method of forming region 215 is generally appreciated to be non-limiting.

Figure 8:
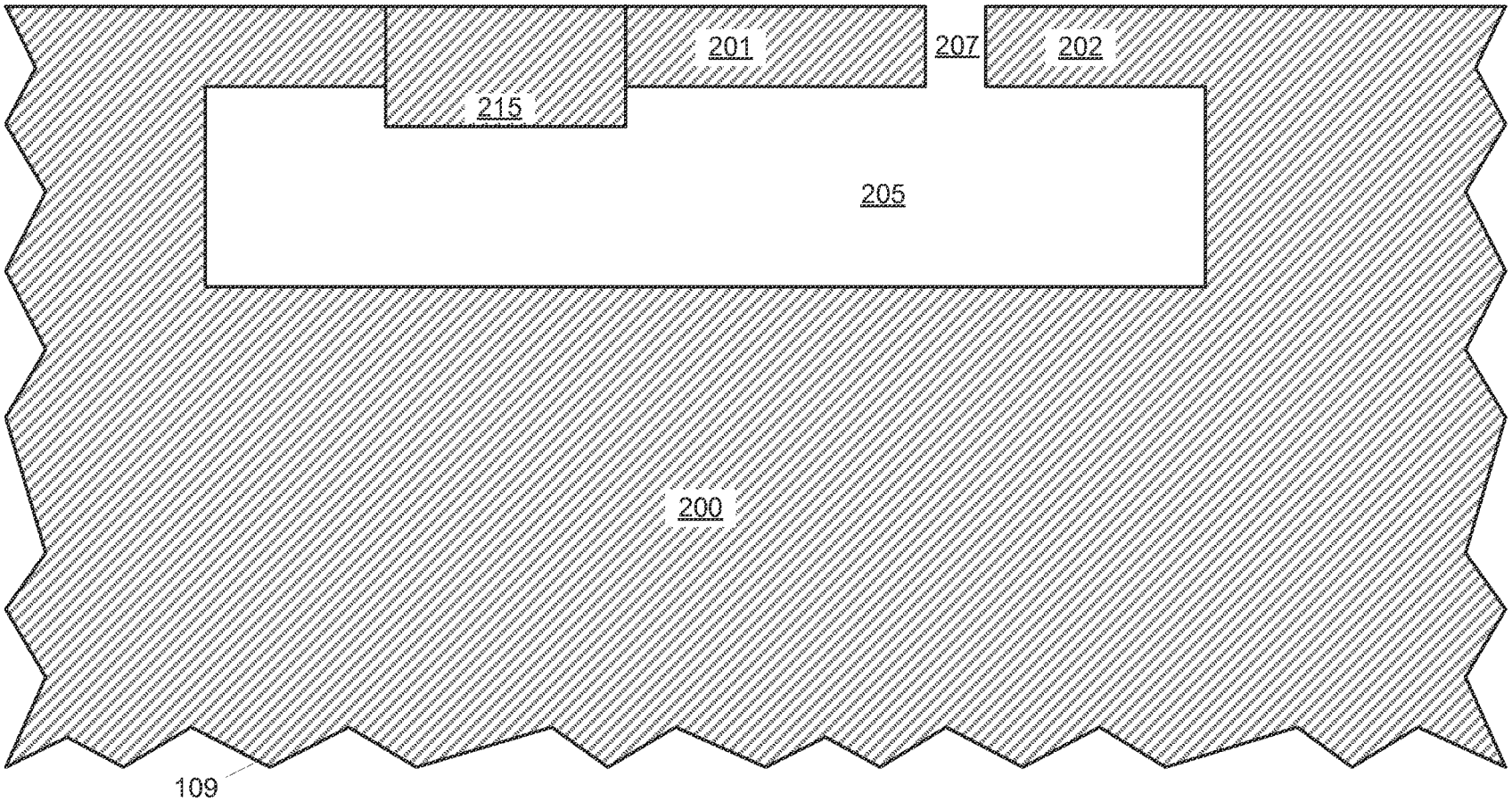
FIG. 8 depicts the chassis of FIG. 7 further adapted to widen a portion of a length of the first radiating arm, according to non-limiting implementations.

In alternative implementations, and as depicted in FIG. 8, first radiating arm 201 can be adapted to increase a width of first radiating arm 201 in region 215. FIG. 8 is similar to FIG. 6, but with conducting material added to region 215 to widen first radiating arm 201. For example, as depicted, one or more of conducting foil, conducting material and the like can be wrapped around and/or attached to first radiating arm 201 in region 215 to widen first radiating arm, presuming electrical contact is made between the conducting foil, conducting material and the like and first radiating arm 201; alternatively, conducting material can be attached to an edge of first radiating arm 201 in region 215 to widen first radiating arm 201.

It is further appreciated that, in some implementations, region 215 can be integral with a remainder of first radiating arm 201 (e.g. as in FIG. 2), while in other implementations region 215 can be removably attached to a remainder of first radiating arm 201, as in FIG. 8.

It is appreciated that chassis 109 depicted in FIG. 8 can then be further adapted to add third radiating arm 203 as depicted in FIG. 2. For example, third radiating arm 203 can be mounted on non-conducting material within opening 205 and/or underneath opening 205.

Hence, the sequence of FIGS. 6, 7, 8 and 2 depict chassis 109 being adapted to include antenna 115. However, the steps for adapting chassis 109 to include antenna 115 need not be performed in the order as described above. For example, gap 207 can be formed before or after region 215 is formed and/or third radiating arm 203 is added. Indeed the sequence depicted in FIGS. 6, 7, 8 and 2 can be performed in any order that results in the configuration of FIG. 2.

Figure 9:
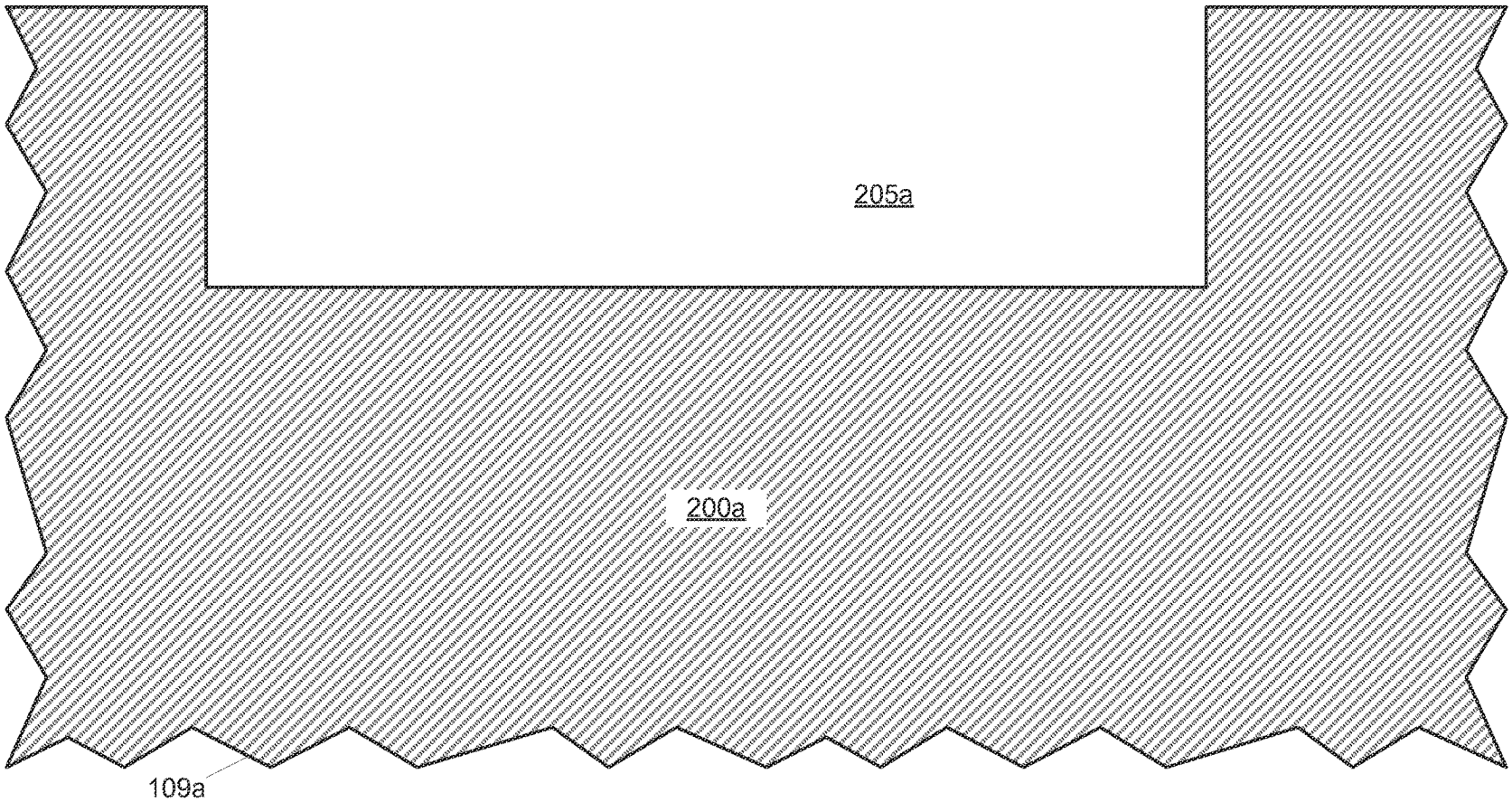
FIG. 9 depicts an alternative portion of the chassis of the device of FIG. 1 prior to being adapted to include a coupled-feed wideband antenna, according to non-limiting implementations.
Figure 10:
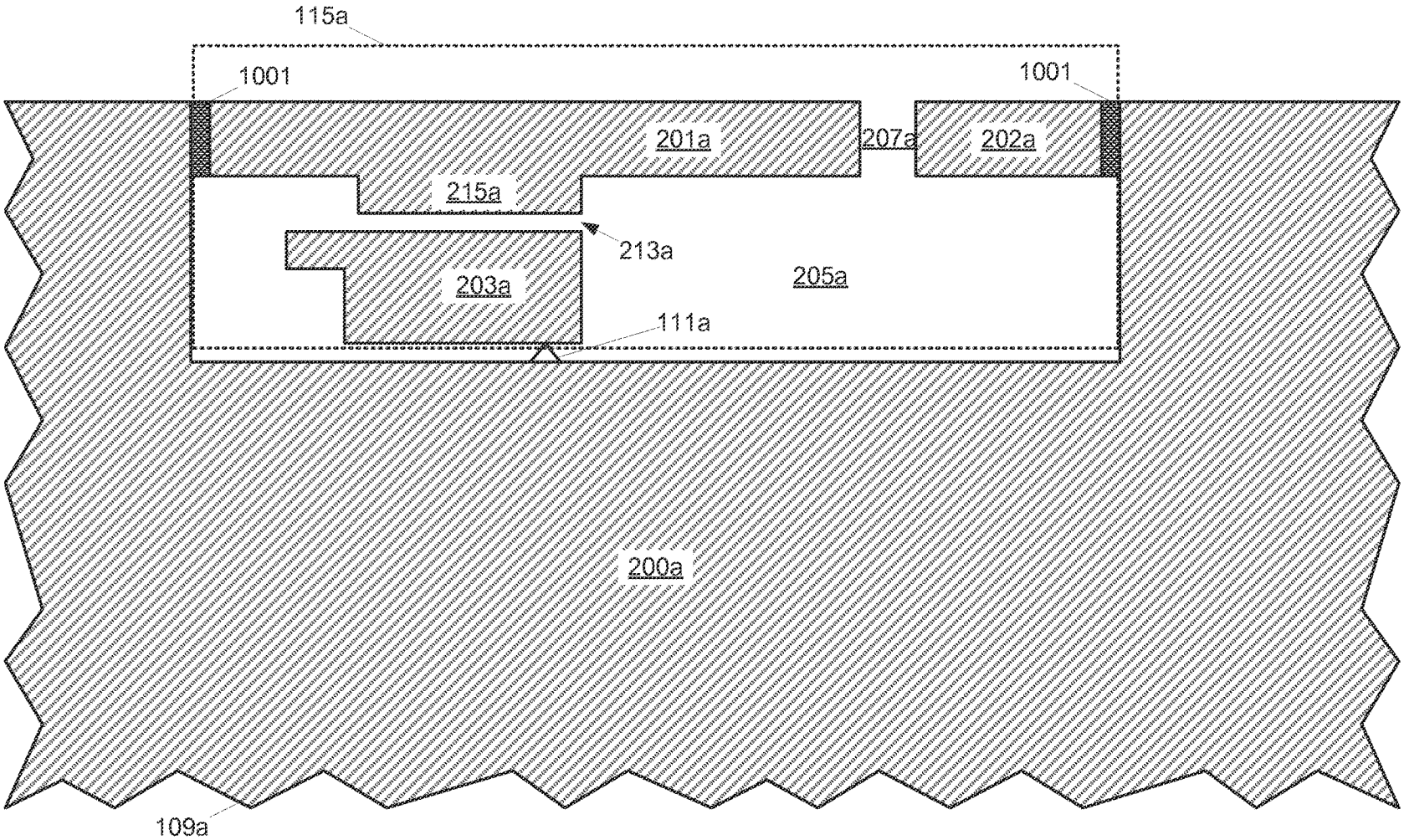
FIG. 10 depicts the portion of the chassis of FIG. 9 adapted to include the coupled-feed wideband antenna, according to non-limiting implementations.

Attention is next directed to FIG. 9, which depicts an alternate chassis 109*a* comprising a ground plane 200*a* and an opening 205*a*, respectively similar to chassis 109 and ground plane 200, however opening 205*a* comprises an open cutout of chassis 109*a* rather than an aperture. In any event, attention is next directed to FIG. 10 which depicts chassis 109*a* adapted to include an antenna 115*a*, which is similar to antenna 115. FIG. 10 is similar to FIG. 2, with like elements having like numbers, but with an "a" appended thereto; further, while not all components of FIG. 10 are labelled similar to FIG. 2, they are appreciated to be nonetheless present.

Hence, antenna 115*a* comprises a first radiating arm 201*a* having a region 215*a*, a second radiating arm 202*a*, and a third radiating arm 203*a*, each respectively similar to first radiating arm 201, second radiating arm 202, and third radiating arm 203, with a gap 207*a* between first radiating arm 201*a* and second radiating arm 202*a*, similar to gap 207, and a gap 213*a* between first radiating arm 201*a*, and third radiating arm 203*a*, similar to gap 213. Further, an antenna feed 111*a* is connected to third radiating arm 203*a* and ground plane 200*a*, similar to antenna feed 111. In other words, antenna 115*a* is similar to antenna 115, however first radiating arm 201*a* and second radiating arm 202*a* are not integral with chassis 109*a*; rather first radiating arm 201*a* and second radiating arm 202*a* are physically and electrically attached to chassis 109*a* using respective attachment portions 1001. Each attachment portion 1001 can comprise one or more of a spring, an electrical connector, a conducting material and the like; however, in general, respective attachment portions 1001 are each configured to attach first radiating arm 201*a* and second radiating arm 202*a* to chassis 109*a* in opening 205*a*.

Persons skilled in the art will appreciate that there are yet more alternative implementations and modifications possible. For example, attention is directed to FIG. 11 which depicts another non-limiting implementation of a chassis 109*b* comprising a ground plane 200*b*, an opening 205*b*, and an antenna 115*b*, similar to antenna 115. Indeed, FIG. 11 is similar to FIG. 2, with like elements having like numbers, but with a "b" appended thereto; further, while not all components of FIG. 11 are labelled similar to FIG. 2, there are appreciated to be nonetheless present. Hence, antenna 115*b* comprises a first radiating arm 201*b*, having a region 215*b*, a second radiating arm 202*b*, and a third radiating arm 203*b*, each respectively similar to first radiating arm 201, second radiating arm 202, and third radiating arm 203, with a gap 207*b* between first radiating arm 201*b* and second radiating arm 202*b*, similar to gap 207, and a gap 213*b* between first radiating arm 201*b*, and third radiating arm 203*b*, similar to gap 213. Further, an antenna feed 111*b* is connected to third radiating arm 203*b* and ground plane 200*b*, similar to antenna feed 111. Hence, antenna 115*b* is similar to antenna 115, however each of first radiating arm 201*b* and second radiating arm 202*b* are "L" shaped, at respective radiating ends adjacent gap 207*b*. Indeed, in other implementations, only one of first radiating arm 201*b* and second radiating arm 202*b* can be "L" shaped. Further the specific shape of each of first radiating arm 201*b*, second radiating arm 202*b* and third radiating arm 203*b* are not specifically limited to those shapes depicted herein, but can be determined heuristally and/or experimentally.

In any event, a versatile coupled-feed wideband antenna is described herein that can replace a plurality of antennas at a mobile electronic device. The specific resonance bands of the antennas described herein can be varied by varying the dimensions of components of the antenna to advantageously align the bands with bands used by service providers to provide communication providers. Further, the present antenna obviates the need to use different antennas for different bands in different regions as the width of resonance in each frequency band is also wide enough to accommodate a plurality of channels in each band.

A portion of the disclosure of this patent document contains material which is subject to copyright protection. The copyright owner has no objection to the facsimile reproduction by any one of the patent document or patent disclosure, as it appears in the Patent and Trademark Office patent file or records, but otherwise reserves all copyrights whatsoever.

Persons skilled in the art will appreciate that there are yet more alternative implementations and modifications possible, and that the above examples are only illustrations of one or more implementations. The scope, therefore, is only to be limited by the claims appended here.

What is claimed is:

1. A device comprising:

a chassis comprising a ground plane;

an antenna feed, a ground side of the antenna feed connected to the ground plane; and, an antenna comprising:

a first radiating arm configured to generate a first resonance at a first frequency, the first radiating arm connected to the ground plane;

a second radiating arm configured to generate a second resonance at a second frequency higher than the first frequency, the second radiating arm connected to the ground plane; the first radiating arm, the second radiating arm and the ground plane defining edges of an opening, the first radiating arm and the second radiating arm extending towards each other from the ground plane and arranged along a line extending along an outer edge of the opening; radiating ends of each of the first radiating arm and the second radiating arm separated by a first gap along the line; and a third radiating arm configured to generate a third resonance at a third frequency higher than the second frequency, the third radiating arm connected to a positive side of the antenna feed, the third radiating arm located within the opening, and separated from the ground plane by at least a second gap configured to electrically isolate the third radiating arm from the ground plane, the first radiating arm and the third radiating arm being capacitively coupled across a third gap and otherwise being isolated from each other such that there is no direct connection between the positive side of the antenna feed and either of the first radiating arm and the second radiating arm, each of the ground plane, the first radiating arm, the second radiating arm, the opening and the third radiating arm all being in a common plane.

2. The device of claim 1, wherein the first resonance comprises a frequency range from about 700 MHz to about 960 MHz.

3. The device of claim 1, wherein the second resonance comprises a frequency range from about 1710 MHz to about 2170 MHz.

4. The device of claim 1, wherein the third resonance comprises a frequency range from about 2500 MHz to about 2700 MHz.

5. The device of claim 1, wherein the third radiating arm comprises a first rectangle and a second rectangle smaller than the first rectangle and forming an L-shape with the first rectangle.

6. The device of claim 1, wherein the first gap between the first radiating arm and the second radiating arm is configured to prevent capacitive coupling there between.

7. The device of claim 1, wherein the third gap is less than about 1 mm wide.

8. The device of claim 1, wherein the first radiating arm comprises a larger width than a remainder of the first radiating arm in a region that forms the third gap with the third radiating arm.

9. The device of claim 8, wherein the region is about 23.5 mm long.

10. The device of claim 1, wherein the first radiating arm is about 53 mm long.

11. The device of claim 1, wherein the second radiating arm is about 11 mm long.

12. The device of claim 1, wherein the third radiating arm comprises a first rectangle that is about 6.5 mm by about 25 mm, and a second rectangle extending from a small edge of the first rectangle, the second rectangle being about 5 mm by about 3.3 mm.

13. The device of claim 1, wherein one or more of the first radiating arm and the second radiating arm are L-shaped.

14. The device of claim 1, wherein the ground plane comprises one or more of a conducting material and a conducting metal.

15. The device of claim 1, wherein the antenna is at least partially integrated with the chassis.

16. The device of claim 1, wherein the first radiating arm and the second radiating arm are connected to the ground plane using attachment portions.

* * * * *